US012628998B2

(12) United States Patent
Cullen et al.

(10) Patent No.: US 12,628,998 B2
(45) Date of Patent: May 19, 2026

(54) DISHWASHER

(71) Applicant: WHIRLPOOL CORPORATION, Benton Harbor, MI (US)

(72) Inventors: Christopher D. Cullen, Stevensville, MI (US); Rebecca Katherine Kasner, Saint Joseph, MI (US); Richard Lee Hammond, Mattawan, MI (US); Elliott Vernon Stowe, Stevensville, MI (US); Avery Josephine Saylor, St. Joseph, MI (US); Chandler Alexander Longley, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 256 days.

(21) Appl. No.: 18/360,942

(22) Filed: Jul. 28, 2023

(65) Prior Publication Data

US 2024/0032771 A1 Feb. 1, 2024

Related U.S. Application Data

(60) Provisional application No. 63/394,081, filed on Aug. 1, 2022.

(51) Int. Cl.
*A47L 15/44* (2006.01)

(52) U.S. Cl.
CPC ..... *A47L 15/4472* (2013.01); *A47L 15/4463* (2013.01); *A47L 15/4454* (2013.01); *A47L 2501/07* (2013.01); *A47L 2501/30* (2013.01)

(58) Field of Classification Search
CPC ..... A47L 15/4472; A47L 15/4463; A47L 15/4454; A47L 2501/07; A47L 2501/30
See application file for complete search history.

(56) References Cited

U.S. PATENT DOCUMENTS 4,441,867 A 4/1984 Berelson
8,613,805 B2 * 12/2013 Classen ..... A47L 15/4463 68/17 R
8,651,336 B2 2/2014 Gadini et al.
9,163,349 B2 10/2015 Classen et al.
(Continued)

FOREIGN PATENT DOCUMENTS

EP 3751041 A1 * 12/2020 ..... A47L 15/0055
WO WO-2009022101 A1 * 2/2009 ..... A47L 15/4463
(Continued)

*Primary Examiner* — Benjamin L Osterhout
(74) *Attorney, Agent, or Firm* — McGarry Bair PC

(57) ABSTRACT

A dishwasher with for treating dishes according to a cycle of operation. The dishwasher has a chassis comprising a base on which is supported a open-faced tub, which at least partially defines a treating chamber; a closure selectively moveable between and an open position and a closed position to selectively open and close the open-faced tub, a controller for selectively controlling the cycle of operation of the dishwasher, and a dispenser assembly comprising an engagement assembly in communication with the controller; the engagement assembly operably coupled with at least one of a dispensing device and one or more dispensing cartridges to adjust the position of one of the dispensing device and/or the dispensing cartridges to selectively dispense treating chemistry from the selected dispensing cartridge.

22 Claims, 5 Drawing Sheets

(56) References Cited

U.S. PATENT DOCUMENTS

| | | | | |
|---|---|---|---|---|
| 9,717,393 | B2 | 8/2017 | Delgado et al. | |
| 9,988,754 | B2 | 6/2018 | Kakaraparthi | |
| 11,147,431 | B2 | 10/2021 | Fawaz et al. | |
| 2009/0090401 | A1 | 4/2009 | Feddema | |
| 2010/0043852 | A1* | 2/2010 | Classen | A47L 15/4472 422/255 |
| 2011/0226808 | A1* | 9/2011 | Lonski | D06F 39/02 222/173 |
| 2013/0269736 | A1* | 10/2013 | Baldwin | A47L 15/14 134/60 |
| 2014/0060581 | A1* | 3/2014 | Alexander | A47L 15/449 68/17 R |
| 2015/0359412 | A1* | 12/2015 | Delgado | A47L 15/4463 134/198 |
| 2017/0127905 | A1* | 5/2017 | DeWeerd | A47L 15/0055 |
| 2018/0014715 | A1* | 1/2018 | Heiligenmann | A47L 15/4463 |
| 2020/0093347 | A1* | 3/2020 | Shashidhar | A47L 15/449 |
| 2021/0053018 | A1 | 2/2021 | Dyer | |
| 2022/0095885 | A1 | 3/2022 | Boyer et al. | |

FOREIGN PATENT DOCUMENTS

| | | | | |
|---|---|---|---|---|
| WO | WO-2009022223 | A2 * | 2/2009 | A47L 15/4463 |
| WO | WO-2010006761 | A2 * | 1/2010 | A47L 15/4463 |
| WO | WO-2021191118 | A1 * | 9/2021 | D06F 15/4463 |
| WO | 2021/245612 | A1 | 12/2021 | |
| WO | WO-2022194952 | A1 * | 9/2022 | |

* cited by examiner

DISHWASHER

CROSS-REFERENCE TO RELATED APPLICATION

This application claims the benefit of U.S. Application 63/394,081, filed Aug. 1, 2022.

BACKGROUND

Typical dishwashers comprise dispensing assemblies that contain reservoirs configured to hold one or more treating chemistries for use during a cycle of operation. A user typically fills one or more reservoirs with single dosages of treating chemistry prior to the cycle of operation. There is no way to change the timing or control the dispensing of any of the various treating chemistries during a cycle of operation. Additionally, once a treating chemistry is dispensed during a cycle of operation, there is no way to dispense additional treating chemistry.

BRIEF DESCRIPTION

The present disclosure relates to a dishwasher for treating dishes according to a cycle of operation. The dishwasher has a chassis comprising a base on which is supported a open-faced tub, which at least partially defines a treating chamber; a closure selectively moveable between and an open position and a closed position to selectively open and close the open-faced tub, a controller for selectively controlling the cycle of operation of the dishwasher, and a dispenser assembly comprising an engagement assembly in communication with the controller; the engagement assembly operably coupled with at least one of a dispensing device and one or more dispensing cartridges to adjust the position of one of the dispensing device and/or the dispensing cartridges to selectively dispense treating chemistry from the selected dispensing cartridge.

In one aspect of the invention, the invention contemplates a dishwasher for treating dishes according to a cycle of operation, the dishwasher comprising a chassis comprising a base on which is supported an open-faced tub, which at least partially defines a treating chamber and a closure selectively moveable between and an open position and a closed position to selectively open and close the open-faced tub. A controller can be provided for selectively controlling the cycle of operation of the dishwasher. A dispenser assembly can comprise an engagement assembly in communication with the controller. The engagement assembly can be operably coupled with at least one of a dispensing device and one or more dispensing cartridges to adjust the position of one of the dispensing device and/or the dispensing cartridges to selectively dispense treating chemistry from the selected dispensing cartridge.

Various embodiments of the invention are also contemplated without departing from the scope of the invention described herein. One or more of the dispensing cartridges can be mounted for movement with respect to the dispensing device. One or more dispensing cartridges can be mounted for substantially linear movement with respect to the dispensing device. One or more dispensing cartridges can be mounted for substantially rotational movement with respect to the dispensing device. One or more dispensing cartridges can comprise at least three dispensing cartridges.

In another aspect of the invention, a dishwasher for treating dishes according to a cycle of operation, the dishwasher can comprise a chassis comprising a base on which is supported an open-faced tub, which at least partially defines a treating chamber and a closure selectively moveable between and an open position and a closed position to selectively open and close the open-faced tub. A controller can be provided for selectively controlling the cycle of operation of the dishwasher. A dispensing device can be provided in communication with the controller. An engagement assembly can comprise a plurality of dispensing cartridges, each of the plurality of dispensing cartridges can have a chamber for receiving a treating chemistry therein and a dispensing port in fluid communication with the chamber thereof. One of the dispensing device and the engagement assembly can be mounted for relative movement with respect to the other of the dispensing device and the engagement assembly with a dispensing device between a plurality of discrete positions in which one of the dispensing ports for a corresponding dispensing cartridge can be fluidly aligned with the dispensing device. The controller can thereby selectively align one of the plurality of the dispensing cartridges with the dispensing device and can selectively dispense treating chemistry from the aligned dispensing cartridge.

Additional embodiments of the invention are also contemplated as well. The engagement assembly can further comprise a carousel and the plurality of dispensing cartridges can be mounted to the carousel in a spaced relationship around a perimeter of the carousel. The carousel can have a round perimeter and each of the dispensing ports on the plurality of the dispensing cartridges can be generally aligned with the perimeter of the carousel. An engagement motor can be operably connected to the controller for imparting rotational movement to the carousel to selectively align one of the plurality of dispensing cartridges with the dispensing assembly. The plurality of dispensing cartridges can be mounted in a generally linear alignment. The dispensing device can be mounted for movement with respect to the engagement assembly. A dispensing device motor can be operably coupled to the controller and to the dispensing device wherein rotational motion provided by the motor can move the dispensing device to align with a selected one of the plurality of dispensing cartridges. A worm gear can be operably interconnected to the dispensing device motor, and the dispensing device can further comprise a liner mount configured to move linearly with rotational movement of the worm gear.

An identification feature can be associated with at least one of the plurality of dispensing cartridges configured to provide a signal representative of identifying information regarding its corresponding at least one of the dispensing cartridges. The dispensing device can comprise a reader adapted to detect information associated with the identification feature associated with at least one of the plurality of dispensing cartridges. The identification feature can comprise an RFID device. The identification feature can comprise a transmitter configured to transmit a signal representative of at least one of an identifier of the corresponding dispensing cartridge and a treating chemistry product contained therein. The reader can comprise a receiver configured to receive the signal transmitted from the identification feature.

The dispensing device and the engagement assembly can be contained within an interior of the closure and movable with the closure. An access panel can be provided in the closure moveable to an open position wherein at least one of the dispensing device and the engagement assembly can be accessed from a position exterior to the closure.

At least one of the dispensing cartridges can be refillable. An identification feature can be associated with at least one of the plurality of dispensing cartridges configured to provide a signal representative of information regarding its corresponding at least one of the dispensing cartridges, the signal representative of at least one of content contained therein, the size thereof, a manufacturer or brand of treating chemistry associated therewith, a remaining amount of treating chemistry therein, an initial amount of treating chemistry contained therein, whether it is single-use or multiple-use, authenticity thereof, and/or approximate volume of treating chemistry remaining therein.

DETAILED DESCRIPTION

Figure 1:
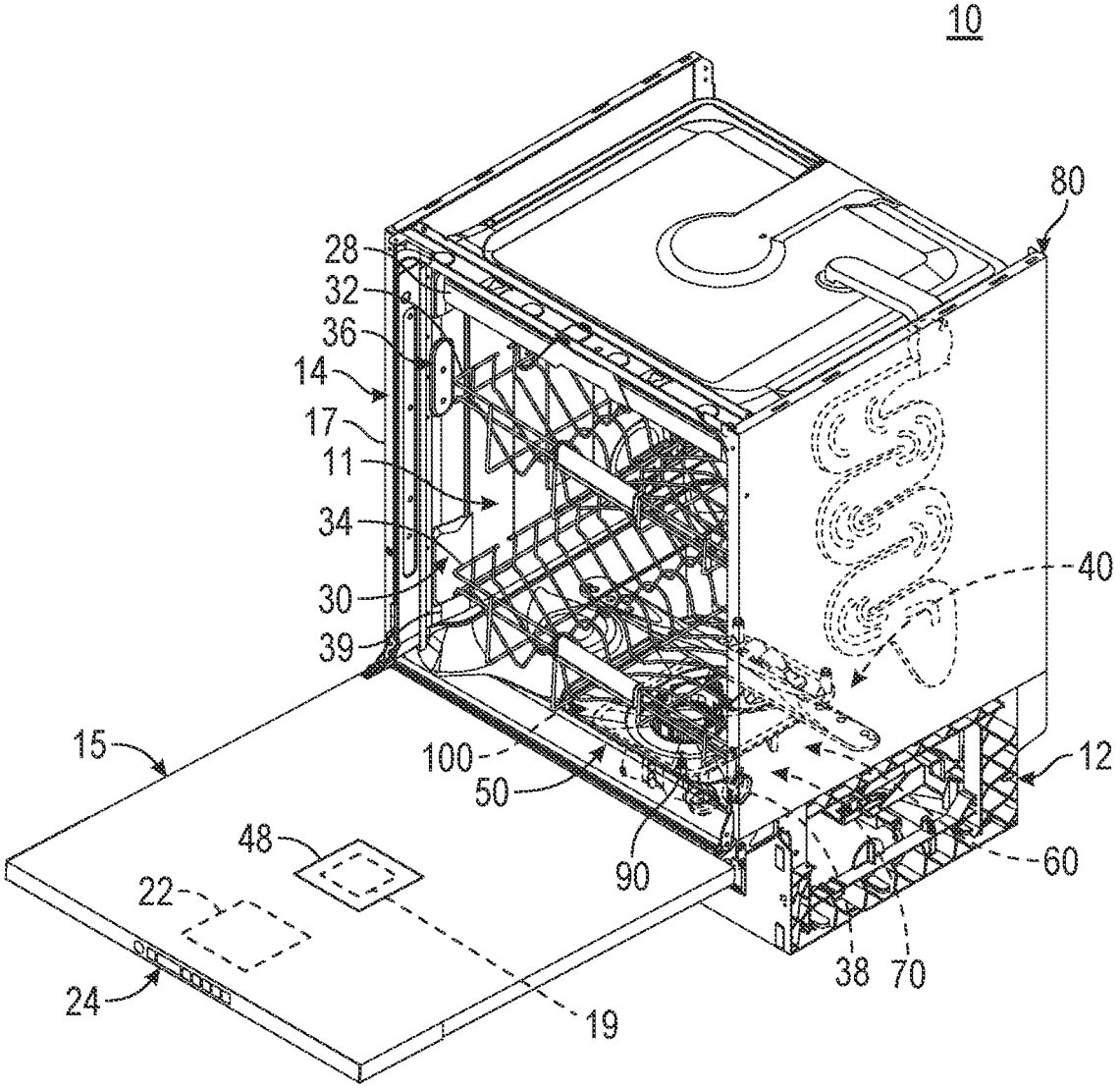
FIG. 1 is a right-side perspective view of an automatic dishwasher having multiple systems for implementing an automatic cycle of operation.

FIG. 1 illustrates an automatic dishwasher 10 capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, for example.

The dishwasher 10 has a variety of systems, some of which are controllable, to implement the automatic cycle of operation. A chassis 13 is provided to support the variety of systems needed to implement the automatic cycle of operation. As illustrated, for a built-in implementation, the chassis 13 includes a frame in the form of a base 12 on which is supported an open-faced tub 14, which at least partially defines a treating chamber 11, having an open face 17, for receiving the dishes. A closure in the form of a door assembly 15 is pivotally mounted to the base 12 for movement between opened and closed positions to selectively open and close the open face 17 of the tub 14. Thus, the door assembly 15 provides selective accessibility to the treating chamber 11 for the loading and unloading of dishes or other items.

The chassis 13, as in the case of the built-in dishwasher implementation, can be formed by other parts of the dishwasher 10, like the tub 14 and the door assembly 15, in addition to a dedicated frame structure, like the base 12, with them all collectively forming a uni-body frame to which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include dish holding system 30, spray system 40, recirculation system 50, drain system 60, water supply system 70, drying system 80, heating system 90, and filter system 100. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can included the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls the various components of the dishwasher 10 to implement the cycle of operation. The controller 22 can be located within the door assembly 15 as illustrated, or it can alternatively be located somewhere within the chassis. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 11. Exemplary dish holders are illustrated in the form of upper dish racks 32 and lower dish rack 34, commonly referred to as "racks", which are located within the treating chamber 11. The upper dish racks 32 and the lower dish rack 34 are typically mounted for slidable movement in and out of the treating chamber 11 through the open face 17 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 15, when the door assembly 15 is in the opened position.

Dedicated dish holders can also be provided. One such dedicated dish holder is a third level rack 28 located above the upper dish rack 32. Like the upper dish rack 32, the third level rack is slidably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. Typically, the height of the third level rack is short enough that a typical glass cannot be stood vertically in the third level rack 28 and the third level rack 28 still slide into the treating chamber 11.

Another dedicated dish holder can be a silverware basket (not shown), which is typically carried by one of the upper or lower dish racks 32, 34 or mounted to the door assembly 15. The silverware basket typically holds utensils and the like in an upright orientation as compared to the on-the-side or flat orientation of the third level rack 28.

A dispenser assembly 48 is provided to dispense treating chemistry, e.g. detergent, anti-spotting agent, etc., into the treating chamber 11. The dispenser assembly 48 can be mounted on an inner surface of the door assembly 15, as shown, or can be located at other positions within the chassis. As will be further illustrated in FIGS. 4A-5, the dispenser assembly 48 can be defined by a cartridge port 19 in the door assembly 15 or other location within the dishwasher for receiving one or more dispensing cartridges 20A-D which can dispense one or more types of treating chemistries. The dispenser assembly 48 can be a single-use dispenser or a bulk dispenser, or a combination of both.

Figure 2:
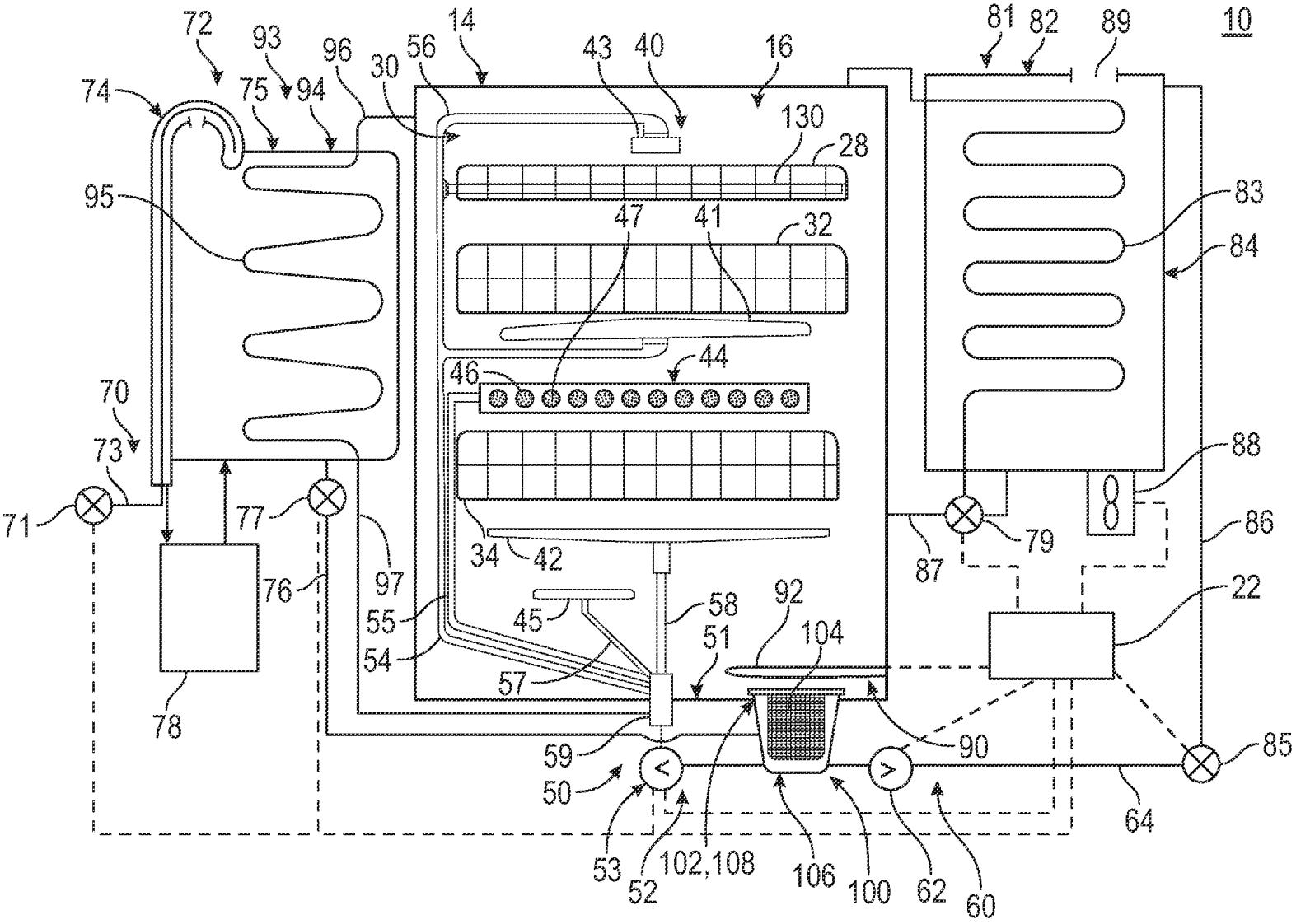
FIG. 2 is a schematic view of the dishwasher of FIG. 1 and illustrating at least some of the plumbing and electrical connections between at least some of systems.

Turning to FIG. 2, the spray system 40 is provided for spraying liquid in the treating chamber 11 and can have multiple spray assemblies or sprayers, some of which can be dedicated to a particular one of the dish holders, to particular area of a dish holder, to a particular type of cleaning, or to a particular level of cleaning, etc. The sprayers can be fixed or movable, such as rotating, relative to the treating chamber 11 or dish holder. Six exemplary sprayers are illustrated and include, an upper spray arm 41, a lower spray arm 42, a third level sprayer 43, a deep-clean sprayer 44, and a spot sprayer 45. The upper spray arm 41 and lower spray arm 42 are rotating spray arms, located below the upper dish rack 32 and lower dish rack 34, respectively, and rotate about a generally centrally located and vertical axis. The third level sprayer 43 is located above the third level rack 28. The third level sprayer 43 is illustrated as being fixed, but could move, such as in rotating. In addition to the third level sprayer 43 or in place of the third level sprayer 43, the sprayer 130 can be located at least in part below a portion of the third level rack 28. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or move, such as in rotating. The spray emitted by the deep-clean sprayer 44 defines a deep clean zone, which, as illustrated, would like along a rear side of the lower dish rack 34. Thus, dishes needing deep cleaning, such as dishes with baked-on food, can be located in the lower dish rack 34 to face the deep-clean sprayer 44. The deep-clean sprayer 44, while illustrated as only one unit on a rear wall of the tub 14 could comprises multiple units and/or extend along multiple portions, including different walls, of the tub 14, and can be provide above, below or beside any of the dish holders with deep-cleaning is desired.

The spot sprayer 45, like the deep-clean sprayer, can emit an intensified and/or higher pressure spray, especially to a discrete location within one of the dish holders. While the spot sprayer 45 is shown below the lower dish rack 34, it could be adjacent any part of any dish holder or along any wall of the tub where special cleaning is desired. In the illustrated location below the lower dish rack 34, the spot sprayer can be used independently of or in combination with the lower spray arm 42. The spot sprayer 45 can be fixed or can move, such as in rotating.

These six sprayers are illustrative examples of suitable sprayers and are not meant to be limiting as to the type of suitable sprayers.

The recirculation system 50 recirculates the liquid sprayed into the treating chamber 11 by the sprayers of the spray system 40 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 11 and can be formed by a sloped or recess portion of a bottom wall of the tub 14. The pump assembly 52 can include one or more pumps such as recirculation pump 53. The sump 51 can also be a separate module that is affixed to the bottom wall and include the pump assembly 52.

Multiple supply conduits 54, 55, 56, 57, 58 fluidly couple the sprayers 28-44 to the recirculation pump 53. A recirculation valve 59 can selectively fluidly couple each of the conduits 54-58 to the recirculation pump 53. While each sprayer 28-44 is illustrated as having a corresponding dedicated supply conduit 54-58 one or more subsets, comprising multiple sprayers from the total group of sprayers 28-44, can be supplied by the same conduit, negating the need for a dedicated conduit for each sprayer. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits can be directly coupled to the recirculation pump 53, while one or more of the other conduits can be selectively coupled to the recirculation pump with one or more valves. There are essentially an unlimited number of plumbing schemes to connect the recirculation system 50 to the spray system 40. The illustrated plumbing is not limiting.

A drain system 60 drains liquid from the treating chamber 11. The drain system 60 includes a drain pump 62 fluidly coupled the treating chamber 11 to a drain line 64. As illustrated the drain pump 62 fluidly couples the sump 51 to the drain line 64.

While separate recirculation and drain pumps 53 and 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to some extent.

A water supply system 70 is provided for supplying fresh water to the dishwasher 10 from a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 11 where it ultimately evaporates or is drained via the drain pump 62. The serpentine conduit 83 can be operated in an open loop configuration, where the air is exhausted to atmosphere, a closed loop configuration, where the air is returned to the treating chamber 11, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60 or water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 11 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 11, to the cooling tank 84, and back to the treating chamber 11. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 11, then the drain system 60 would supply the cold water in the treating chamber 11 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater, located in the treating chamber 11 at a location where it will be immersed by the water supplied to the treating chamber 11. The heater 92 need not be an immersion heater, it can also be an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 11 to the serpentine conduit 95, and a return conduit 97 fluidly coupled to the treating chamber 11. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 11. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated such as an ultra-filtration system.

Figure 3:
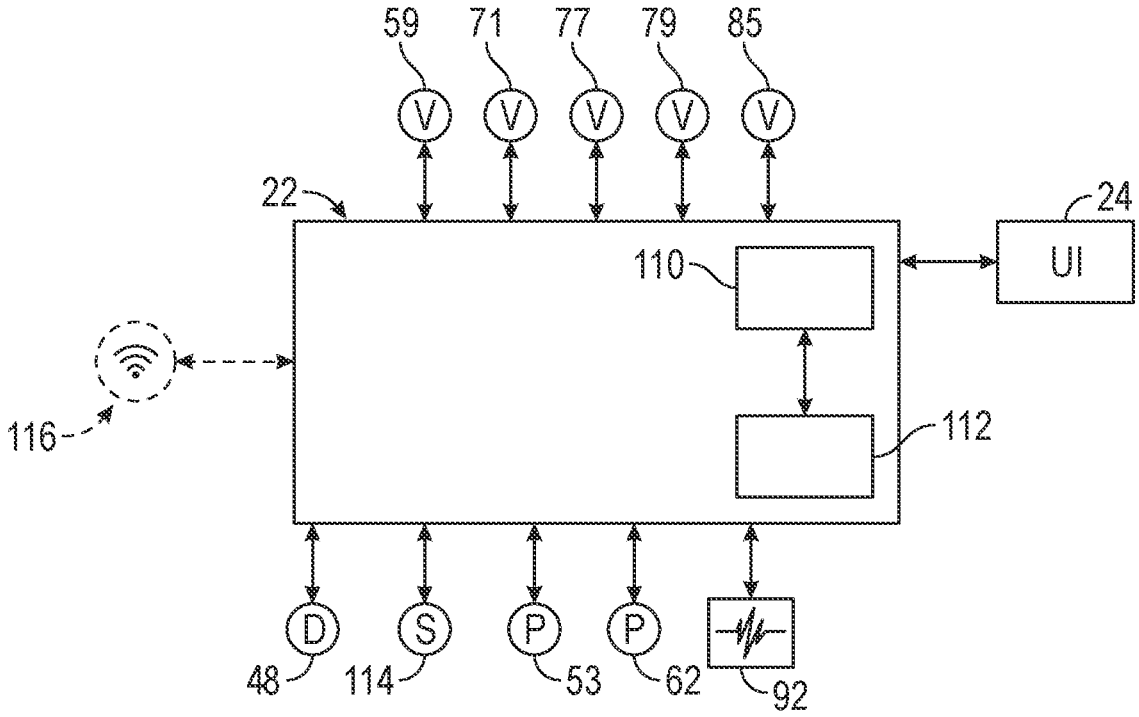
FIG. 3 is a schematic view of a controller of the dishwasher of FIGS. 1 and 2

As illustrated schematically in FIG. 3, the controller 22 can be coupled with the heater 92 for heating the wash liquid during a cycle of operation, the drain pump 62 for draining liquid from the treating chamber 11, and the recirculation pump 53 for recirculating the wash liquid during the cycle of operation and the dispenser assembly 48 for controlling and dispensing treating chemistry during a cycle of operation. The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store one or more pre-programmed automatic cycles of operation that can be selected by a user and executed by the dishwasher 10. The controller 22 can also receive input from one or more sensors 114. Non-limiting examples of sensors that can be communicably coupled with the controller 22 include, to name a few, ambient air temperature sensor, treating chamber temperature sensor, water supply temperature sensor, door open/close sensor, and turbidity sensor to determine the soil load associated with a selected grouping of dishes, such as the dishes associated with a particular area of the treating chamber. The controller 22 can also communicate with the recirculation valve 59, the household water valve 71, the controllable valve 77, the return valve 79, and the valve 85. Optionally, the controller 22 can include or communicate with a wireless communication device 116.

Figure 4B:
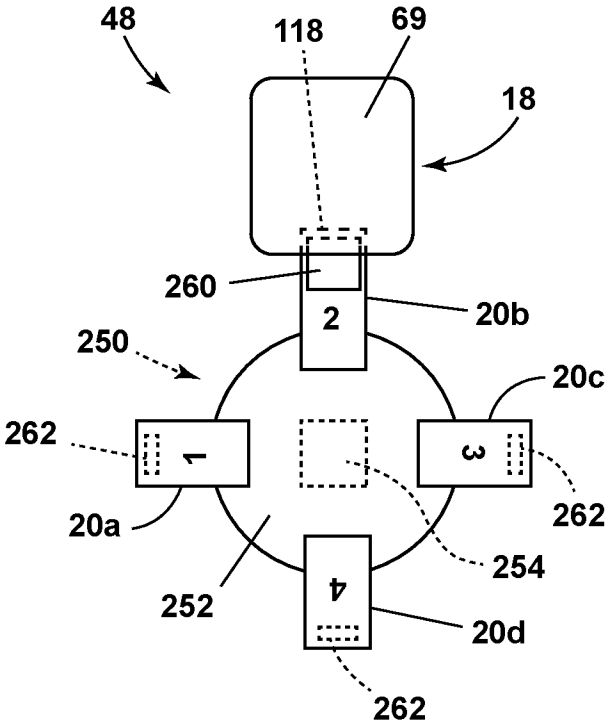
FIG. 4B is a schematic top plan view of the engagement assembly of FIG. 21A with the carousel in a second position.
Figure 4A:
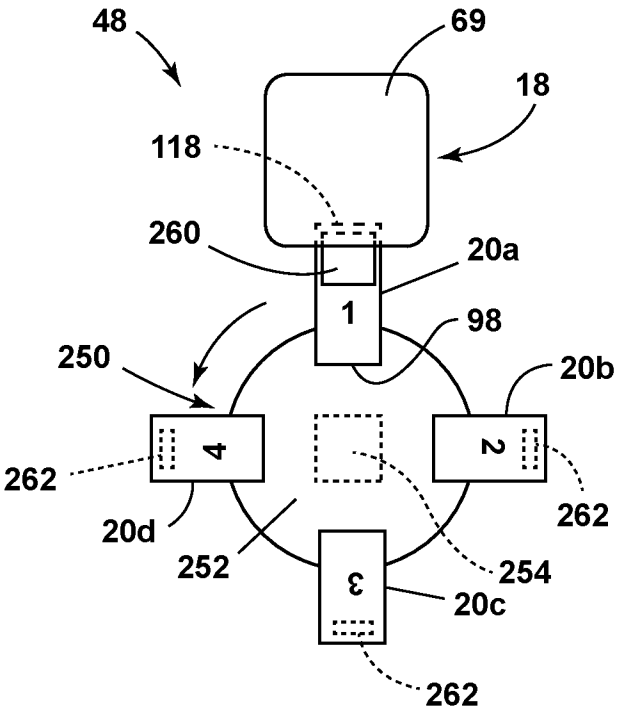
FIG. 4A is a schematic top plan view of an engagement assembly having dispensing cartridges coupled to a rotatable carousel with the carousel in a first position, according to the present disclosure.
Figure 5:
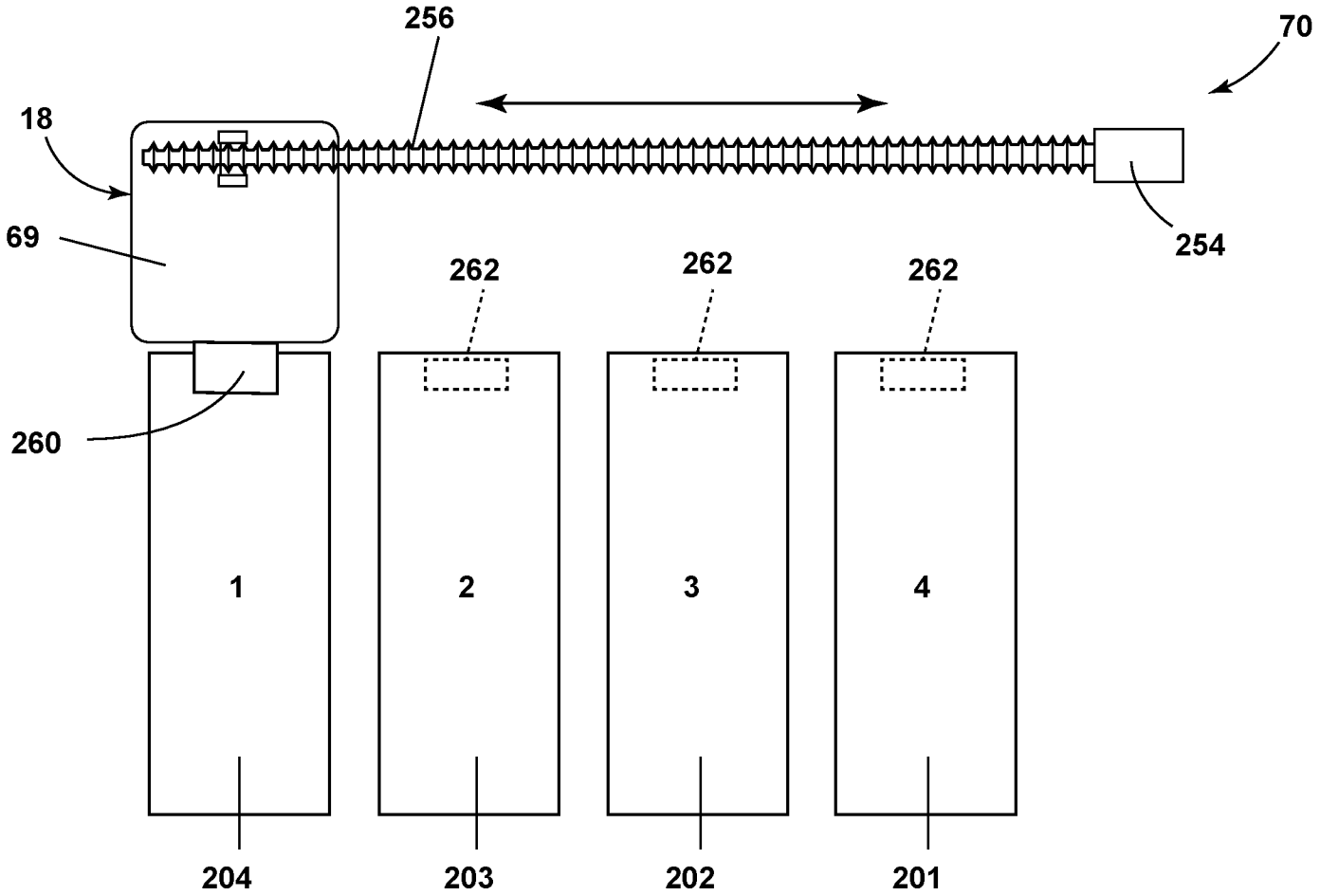
FIG. 5 is a schematic top plan view of an engagement assembly having a rail assembly with a dispensing device coupled thereto, according to the present disclosure.

Referring to FIGS. 4A-5, the dispenser assembly 48 can comprise multiple dispensing cartridges 20A-D positioned within the dishwasher 10 at a single time. Each dispensing cartridge 20A-D can have an insertion end 98 for inserting the cartridge 20A-D into the dispenser assembly 48 and an exposed end 118 for allowing access to the treating chemistry contained in the cartridge. Once the dispensing cartridges 20A-D are installed in the cartridge port 19, the controller 22 can selectively operate a dispensing device 18 to dispense the treating chemistry from the selected dispensing cartridge 20A-D.

The dispenser assembly 48 generally also includes an engagement assembly 250 in communication with the controller 22. The engagement assembly 250 is operably coupled with at least one of the dispensing device 18 and the dispensing cartridges 20A-D to adjust the position of the respective component (e.g., the dispensing device 18 and/or the dispensing cartridges 20A-D). The engagement assembly 250 includes a carousel 252 coupled to each of the dispensing cartridges 20A-D. The carousel 252 is configured to be rotated by a motor 254. The dispensing cartridges 20A-D are arranged in a circular or oblong configuration around the carousel 252. In this configuration, the exposed end 118 is the end engaged by the dispensing device 18, and the insertion end 98 is coupled to the carousel 252. It should be recognized that while FIGS. 4A-B show 4 dispensing cartridges 20A-D any number of dispensing cartridges can be deployed. It should also be appreciated that the positions of both the dispensing device 18 and of the dispensing cartridges 20A-D can be adjusted relative to one another.

The carousel 252 can be rotated relative to the stationary dispensing device 18 to bring the selected dispensing cartridge 20A-D into communication with the dispensing device 18. For example, in FIGS. 4A and 4B four dispensing cartridges 20A-D are illustrated, with the dispensing cartridge 20A initially engaged with the dispensing device 18 in FIG. 4A. When the carousel 252 is rotated, the adjacent dispensing cartridge 20B is engaged with the dispensing device 18 as illustrated in FIG. 4B. It is contemplated can be rotated in a clockwise or counter-clockwise direction for accessibility to each dispensing cartridge 20A-D.

The dispensing device 18 is illustrated as the pump 69. Accordingly, the dispensing cartridges 20A-D selectively engage the pump 69 when rotated to the position adjacent to the pump 69. However, the pump 69 may be included inside each dispensing cartridge 20A-D. In such a configuration, the dispensing device 18 could be configured to engage the pump 69 disposed within the selected dispensing cartridges 20A-D.

The dispenser assembly 48 generally includes an identification device 260. The identification device 260 can be disposed proximate to the cartridge port 16 and as shown in FIGS. 4A-B proximate the dispensing device 18. The identification device 260 is configured to read or otherwise determine information about the dispensing cartridge 20A-D from an identification feature 262 coupled to each dispensing cartridge 20A-D. As the dispenser assembly 48 allows the interchangeability between the dispensing cartridges 20A-D, the identification feature 262 provides information to the controller 22 about each of the dispensing cartridges 20A-D and the treating chemistry contained therein.

The identification feature 262 may include information relating to content within each dispensing cartridge 20A-D, the size of the dispensing cartridge 20A-D, a manufacturer or brand, a remaining amount of treating chemistry, and an initial amount of treating chemistry based on the size of the dispensing cartridge 20A-D, recognition of whether a bulk dispensing cartridge or a single-dose dispensing cartridge is in the cartridge port 16, or combination thereof. The identification feature 262 can provide data relating to the authentication of each dispensing cartridge 20A-D. Additionally or alternatively, the identification feature 262 can be utilized to maintain an approximate volume remaining in each of the dispensing cartridges 20A-D. Further, data communicated from the identification device 260 and/or the identification feature 262 to the controller 22 can influence how the treating chemistry in each of the dispensing cartridges 20A-D is dispensed. In additional or alternative examples, the identification feature 262 provides information to the controller 22 relating to current volume, concentration, density, and/or type of laundry chemistry within each of the dispensing cartridges 20A-D. In this way, the identification feature 262 identifies a variety of information for the controller 22. The information communicated to the controller 22 is utilized by the dishwasher 10 for dispensing the treating chemistry.

The identification device 260 and the corresponding identification feature 262 may include, for example, switches, a near field communication (NFC) reader and associated tags, a radio frequency identification (RFID) device and associated tags, or other similar electrical and data interfaces. Accordingly, the dispenser assembly 48 can identify information about each dispensing cartridge 20A-D inserted into the cartridge port 16, as well as the treating chemistry within each of the dispensing cartridges 20A-D. The information can be obtained when the dispenser assembly 48 detects a new dispensing cartridge disposed within the cartridge port 16, prior to the start of any operating cycle, or at any other practicable time.

As illustrated in FIGS. 4A-B, the identification device 260 can be coupled to the dispensing device 18. As the carousel 252 rotates the dispensing cartridges 20A-D to the position adjacent to the identification device 260, the identification device 260 then reads the information from the identification feature 262, which can be communicated to the controller 22. Once the identification device 260 and/or the controller 22 determines that the dispensing cartridge 20A-D adjacent to the dispensing device 18 includes the selected treating chemistry, the carousel 252 and the motor 254 are deactivated. The dispensing device 18, via pump 69, then engages the dispensing cartridge 20 to dispense the selected treating chemistry.

Referring to FIG. 5, in various examples, the dispensing cartridges 20A-D remain stationary and the dispensing device 18 is adjusted between multiple positions to selectively engage each of the selected dispensing cartridges 20A-D. In such configurations, the engagement assembly 250 includes a rail 256 operably coupled with the motor 254. The dispensing device 18 is slidably engaged with the rail 256 and translated along the rail 256 by the motor 254.

The identification device 260 operates in a similar manner as discussed herein to identify the contents of each of the dispensing cartridges 20A-D through the identification feature 262. Once the identification device 260 determines that the dispensing device 18 is disposed adjacent a dispensing cartridge 20A-D with the selected treating chemistry, the motor 254 is deactivated and the dispensing device 18, via pump 69, engages the selected dispensing cartridge 20A-D.

Accordingly, when multiple dispensing cartridges 20 are disposed within the dishwasher 10, the dispenser assembly 48 determines information about the dispensing cartridges 20A-D to allow the dispensing device 18 to engage the selected dispensing cartridge 20A-D. Further, the dispenser assembly 48 operates to dispense the selected treating chemistry, as well as the selected volume of treating chemistry, into the treatment chamber of the dishwasher 10.

Use of the present device may provide for a variety of advantages. For example, the chassis 13 or door assembly 15 can define the cartridge port 16 to selectively receive multiple configurations of dispensing cartridges 20A-D. Multiple combinations of different sized dispensing cartridges 20A-D can be inserted into the same cartridge port 16. Further, the dispensing cartridges 20A-D can include different types of chemistries, which may be housed in different volumes.

Additionally, the dispensing cartridges 20A-D may be a bulk cartridge used for dosing a predefined amount of treating chemistry and may also be used with single-dose inserts received within the dispensing cartridges 20A-D. Further, the dispensing assembly 48 can adjust the position of one or more dispensing cartridges 20A-D and/or the dispensing device 18 to provide engagement between the dispensing device 18 and the selected dispensing cartridge 20A-D. The engagement assembly 250 can include the carousel 252 for rotating the dispensing cartridges 20A-D relative to the dispensing device 18. Additionally or alternatively, the engagement assembly 250 may include the rail 256 for adjusting the position of the dispensing device 18 relative to the stationary dispensing cartridges 20A-D. The dispensing system 70 can also include the identification device 260 that reads or otherwise obtains information from the identification feature 262 on each of the dispensing cartridges 20A-D. In this way, the dispenser assembly 48 can read the identification feature 262 to derive a variety of information about each dispensing cartridge 20A-D and dispense from the selected dispensing cartridge 20A-D.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher for treating dishes according to a cycle of operation, the dishwasher comprising:

a chassis comprising a base on which is supported an open-faced tub, which at least partially defines a treating chamber;

a closure selectively moveable between an open position and a closed position to selectively open and close the open-faced tub;

a controller for selectively controlling the cycle of operation of the dishwasher; and a dispenser assembly comprising an engagement assembly in communication with the controller, wherein the engagement assembly is operably coupled with at least one of a dispensing device and one or more dispensing cartridges to adjust the position of one of the dispensing device or the dispensing cartridges to selectively dispense treating chemistry from a selected dispensing cartridge.

2. The dishwasher of claim 1 wherein the one or more dispensing cartridges are mounted for movement with respect to the dispensing device.

3. The dishwasher of claim 2 wherein the one or more dispensing cartridges are mounted for substantially linear movement with respect to the dispensing device.

4. The dishwasher of claim 2 wherein the one or more dispensing cartridges are mounted for substantially rotational movement with respect to the dispensing device.

5. The dishwasher of claim 1 wherein the one or more dispensing cartridges comprises at least three dispensing cartridges.

6. A dishwasher for treating dishes according to a cycle of operation, the dishwasher comprising:

a chassis comprising a base on which is supported an open-faced tub, which at least partially defines a treating chamber;

a closure selectively moveable between an open position and a closed position to selectively open and close the open-faced tub;

a controller for selectively controlling the cycle of operation of the dishwasher;

a dispensing device in communication with the controller; and an engagement assembly comprising a plurality of dispensing cartridges, each of the plurality of dispensing cartridges having a chamber for receiving a treating chemistry therein and an end in fluid communication with the chamber thereof;

wherein one of the dispensing device and the engagement assembly is mounted for relative movement with respect to the other of the dispensing device and the engagement assembly between a plurality of discrete positions in which one of the ends for a corresponding dispensing cartridge is fluidly aligned with the dispensing device, whereby the controller is configured to selectively align one of the plurality of the dispensing cartridges with the dispensing device and selectively dispense treating chemistry from the aligned dispensing cartridge.

7. The dishwasher of claim 6 wherein the engagement assembly further comprises a carousel and the plurality of dispensing cartridges are mounted to the carousel in a spaced relationship around a perimeter of the carousel.

8. The dishwasher of claim 7 wherein the carousel has a round perimeter and each of the ends on the plurality of the dispensing cartridges are generally aligned with the perimeter of the carousel.

9. The dishwasher of claim 8 and further comprising an engagement motor operably connected to the controller for imparting rotational movement to the carousel to selectively align one of the plurality of dispensing cartridges with the dispensing device.

10. The dishwasher of claim 6 wherein the plurality of dispensing cartridges are mounted in a generally linear alignment.

11. The dishwasher of claim 10 wherein the dispensing device is mounted for movement with respect to the engagement assembly.

12. The dishwasher of claim 11 and further comprising a dispensing device motor operably coupled to the controller and to the dispensing device wherein rotational motion provided by the motor moves the dispensing device to align with a selected one of the plurality of dispensing cartridges.

13. The dishwasher of claim 12 and further comprising a worm gear operably interconnected to the dispensing device motor, and the dispensing device configured to move linearly with rotational movement of the worm gear.

14. The dishwasher of claim 6 and further comprising an identification feature associated with at least one of the plurality of dispensing cartridges configured to provide a signal representative of identifying information corresponding to at least one of the dispensing cartridges.

15. The dishwasher of claim 14 wherein the dispensing device comprises a reader adapted to detect information associated with the identification feature associated with at least one of the plurality of dispensing cartridges.

16. The dishwasher of claim 15 wherein the identification feature comprises an RFID device.

17. The dishwasher of claim 15 wherein the identification feature comprises a transmitter configured to transmit a signal representative of at least one of an identifier of the corresponding dispensing cartridge and a treating chemistry product contained therein.

18. The dishwasher of claim 17 wherein the reader comprises a receiver configured to receive the signal transmitted from the identification feature.

19. The dishwasher of claim 14 wherein at least one of the dispensing cartridges is refillable.

20. The dishwasher of claim 14 wherein the signal representative of information further comprises a signal representative of at least one of content contained therein, the size thereof, a manufacturer or brand of treating chemistry associated therewith, a remaining amount of treating chemistry therein, an initial amount of treating chemistry contained therein, whether it is single-use or multiple-use, authenticity thereof, or approximate volume of treating chemistry remaining therein.

21. The dishwasher of claim 6 wherein the dispensing device and the engagement assembly are contained within an interior of the closure and moveable with the closure.

22. The dishwasher of claim 21 and further comprising an access panel in the closure moveable to an open position wherein at least one of the dispensing device and the engagement assembly is accessible from a position exterior to the closure.

* * * * *